United States Patent [19]

Safrit et al.

[11] 4,122,555

[45] Oct. 31, 1978

[54] PANTY HOSE WITH CROTCH INSERT AND METHOD

[75] Inventors: Sam C. Safrit, Pfafftown; Kelly W. James, Creedmoor; Roger D. Bullock, Stem, all of N.C.

[73] Assignee: Alamance Industries, Inc., Burlington, N.C.

[21] Appl. No.: 810,524

[22] Filed: Jun. 27, 1977

[51] Int. Cl.[2] ..... A41B 9/04

[52] U.S. Cl. ..... 2/401; 2/407; 2/409

[58] Field of Search ..... 2/409, 401, 406, 407, 2/243 R; 66/177

[56] References Cited

U.S. PATENT DOCUMENTS

| | | | |
|---|---|---|---|
| 625,423 | 5/1899 | Scriven | 2/401 |
| 2,664,570 | 1/1954 | Artzt | 2/401 X |
| 3,613,119 | 10/1971 | Sarmiento | 2/407 |
| 3,909,851 | 10/1975 | Garrou et al. | 2/409 |

FOREIGN PATENT DOCUMENTS

| | | | |
|---|---|---|---|
| 10,361 | 11/1932 | Australia | 2/401 |

*Primary Examiner*—H. Hampton Hunter

*Attorney, Agent, or Firm*—Bell, Seltzer, Park & Gibson

[57] ABSTRACT

The panty hose, or other type of lower body garment, includes a pair of legs and a panty portion with a crotch patch or insert in the crotch area. The crotch insert is formed by severing a predetermined length from a strip of fabric having a width substantially corresponding to the desired width of the crotch insert so that the insert is substantially diamond-shaped with two of the sides being defined by the diagonal cut lines and the remaining two sides being defined by opposite side edges of the strip. The severing of the strip of fabric to form the diamond shaped crotch insert takes place at the location where the panty hose are formed to eliminate the problem heretofore and encountered in handling crotch inserts of the type which are die cut from wide widths of fabric.

7 Claims, 6 Drawing Figures

PANTY HOSE WITH CROTCH INSERT AND METHOD

This invention relates generally to the formation of a panty hose type garment with a crotch insert and more particularly to the formation of the crotch insert by diagonally cutting a relatively narrow strip of fabric having a width substantially corresponding to the desired width of the crotch insert.

Diamond-shaped crotch inserts are commonly used in forming panty hose from a pair of seamless tubular blanks wherein the tubular blanks are longitudinally slit from their upper ends and sewn together along the corresponding slit lines to form the panty portion of the panty hose with the crotch insert being sewn in position between the slit edges and in the crotch area of the panty hose. The crotch inserts are normally die cut from a relatively wide piece of knit material with the wales extending parallel to the length of the crotch insert and the courses extending parallel to the width of the crotch insert and stacks of these crotch inserts are provided at the sewing station where the panty hose blanks are joined together. These stacked crotch inserts tend to cling together and it is difficult for the sewing operator to quickly separate the uppermost crotch insert from the stack and handle the same while it is being sewn in position between the slit edges of the blanks. Also, the stretch characteristics of the crotch insert are somewhat limited because wales and courses are aligned with the length and width of the crotch insert. The possibility of runs developing in the insert is also increased by the fact that all four edges of the diamond-shaped crotch insert are cut edges. Conventional panty hose formed of a pair of slit seamless tubular blanks and including a crotch insert are illustrated in U.S. Pat. No. 3,815,156 and the prior patents set forth therein.

With the foregoing in mind, it is an object of the present invention to provide a panty hose of the type formed by sewing together a pair of slit seamless tubular blanks with a diamond-shaped crotch insert in the crotch area and wherein the crotch insert is formed by diagonally severing a relatively narrow strip of fabric having a width substantially corresponding to the desired width of the crotch insert. The severing of the strip of fabric takes place at the location where the sewing together of the seamless blanks is being carried out so that the handling of the crotch insert by the sewing operator is greatly simplified.

Other objects and advantages of the present invention are achieved in the embodiments illustrated by forming the diamond-shaped crotch inserts from a length of warp knit fabric having a width substantially corresponding to the desired width of the crotch insert and with adjacent wales formed of chains of stitch loops extending parallel to opposite sides of the length of fabric and courses extending across the length of fabric. The narrow length of fabric is preferably knit with an open mesh stitch so that air can pass through the crotch insert formed of the fabric and a moisture absorbent yarn is preferably inlaid on the face side of the fabric which is to be placed on the inside of the panty portion of the panty hose. The crotch insert is formed by severing the strip of warp knit fabric along spaced apart, substantially parallel, diagonal lines so that two of the sides of the diamond-shaped croch insert are defined by the diagonal cut lines and the remaining two sides are defined by opposite selvage edges of the strip. Since two of the sides of the crotch insert are defined by selvage edges of the knit fabric, the likelihood of runs occurring in the crotch insert is reduced. Also, the arrangement of the wales and courses in the crotch insert provides that the crotch insert is cut and positioned on the bias in the crotch portion of the panty, thereby increasing the stretch characteristics of the crotch insert.

Other objects and advantages will appear as the description proceeds when taken in connection with the accompanying drawings, in which FIG. 1 is a perspective view of a seamless knit tubular blank with the lower toe end portion being closed and with the upper portion being longitudinally slit in preparation for the formation of a panty hose garment therefrom;

Figure 6:
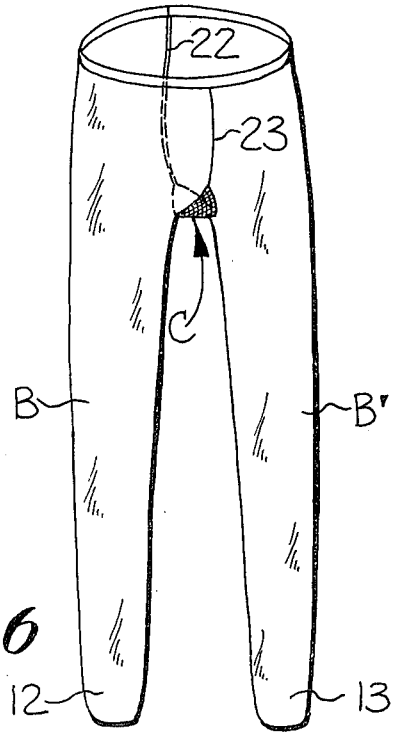
FIG. 6 is a perspective front view of the panty hose of the present invention with the crotch insert positioned in the crotch area.

The lower body garment of the present invention is illustrated in the drawings in the form of a panty hose which is formed by sewing together a pair of seamless tubular blanks and includes a panty portion, indicated at P in FIG. 6, and a pair of legs 10, 11 which are suitably closed at their lower end portions to provide respective toe ends 12 and 13. The toe end portions 12, 13 may be closed in the usual manner and the leg portions 10, 11 may be provided with the usual reciprocatorily knit heel and/or toe pockets, if desired.

Figure 1:
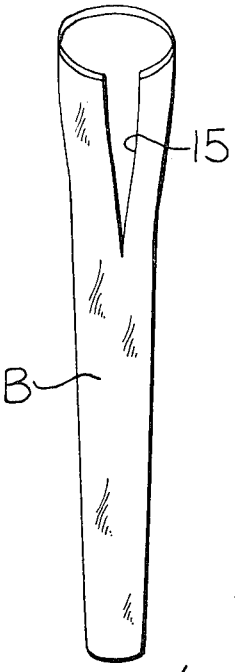

The panty hose is formed from a pair of seamless knit tubular blanks B and B′ (FIG. 5) with each of the blanks being longitudinally slit from the upper waist end and downwardly, as indicated at 15 in FIG. 1, for a predetermined distance, depending upon the length required from the upper waist opening to the crotch area of the panty hose. The diamond-shaped crotch insert or patch, broadly indicated at C, is formed by severing a predetermined length from a strip of fabric having a width substantially corresponding to the desired width of the crotch insert with the predetermined length being severed from the strip of fabric along spaced apart, substantially parallel, diagonal lines, indicated by the dotted lines 16 in FIG. 2, extending across the strip. The diamond-shaped crotch insert C is thus provided with two of the sides, indicated at 17 and 18 in FIG. 3, being defined by the opposite side selvage edges of the strip of fabric and the remaining two sides, indicated at 19 and 20, being defined by the diagonal cut lines.

Figure 5:
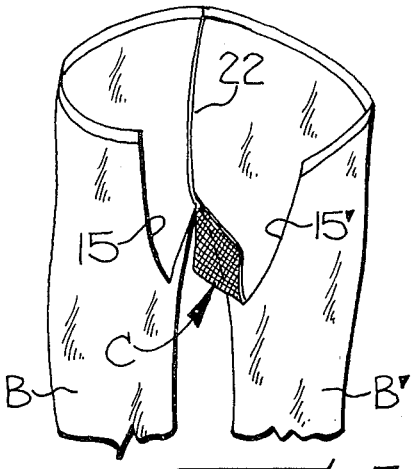
FIG. 5 is a perspective view of the upper end of a panty hose in partially assembled condition.

The formation of the crotch insert from the strip of fabric preferably takes place and at the station where the panty hose blanks are joined together so that the crotch piece may be efficiently handled, either manually by the sewing operator, or by an automatic sewing operation. In the formation of the panty hose in accordance with the present invention, the corresponding slit edges 15, 15′ of the blanks B and B′ are sewn together, preferably with an overedge seam, as illustrated at 22 in FIG. 5, down to a point just above the lower ends of the slits to form the rear seam. Then, a crotch insert is formed by cutting the fabric strip along a diagonal line 16 and the seam 22 is continued around and along the sides 17 and 20 of the crotch insert C, as illustrated in FIG. 5. A front seam, indicated at 23 in FIG. 6, is then formed beginning with the sewing of the slit 15' along the sides 19 and 18 of the crotch insert C and then up the front to join the slits 15, 15' and to secure the crotch patch C in the crotch area of the panty portion of the panty hose and between the slit edges and adjacent the ends of the slits.

Figure 4:
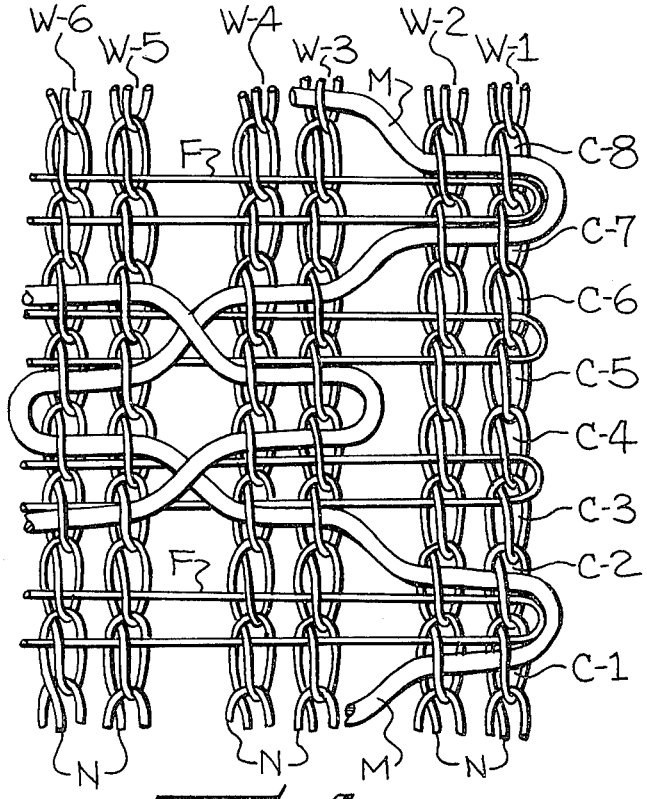
FIG. 4 is a greatly enlarged view of that portion of the crotch insert enclosed in the dash-dot line rectangle indicated at 4 FIG. 3.

As a specific but non-limiting example, the relatively narrow strip of fabric (FIG. 2) from which the crotch insert C is formed is illustrated in FIG. 4 as being warp knit and includes adjacent pairs of chains of stitch loops extending walewise in wales W-1 through W-6. The chains of stitch loops are preferably knit of synthetic stretchable textured yarn, such as nylon indicated at N, to form successive courses C-1 through C-8. The chains of stitch loops are interconnected by an inlaid filling yarn, indicated at F and extending in a coursewise direction to form selvage along opposite sides of the length of fabric. A moisture absorbent yarn, such as cotton indicated at M in FIG. 4, is inlaid in a zig-zag pattern on one face of the fabric strip and the crotch insert C is sewn into the crotch area of the panty hose with this face of the fabric on the inside of the panty portion to aid in absorbing any moisture which might be present.

Figure 3:
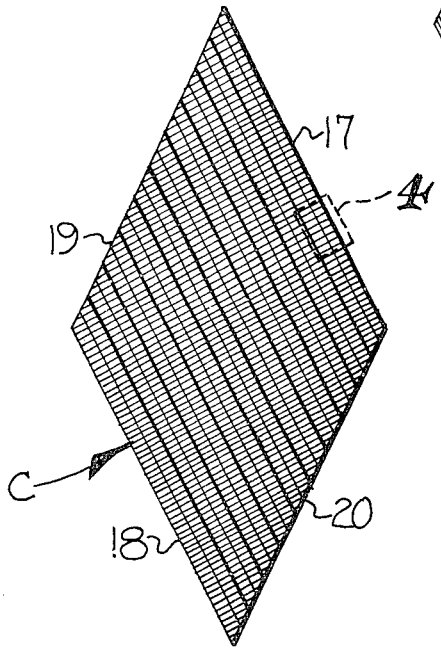
FIG. 3 is an enlarged elevational view of a diamond-shaped crotch insert of the present invention.

Thus, the crotch insert C is of generally diamond-shaped configuration with pointed ends and with the knit wales, indicated by the lines in FIG. 3, extending parallel to the first pair of side edges 17, 18. Courses, indicated by the lines in FIG. 3, extend perpendicular to the wales so that the crotch insert C is sewn into the crotch portion of the panty on the bias. The knit strip of fabric is three inches wide from one selvage edge to the other in relaxed condition and the diagonal lines of cut 16 (FIG. 2) are made at an angle of approximately 50° from the selvage edges 17, 18. The distance between the diagonal cuts is substantially equal to the length of the cuts and each of the side edges 17-20 is three and three quarter inches long while the width of the crotch insert C is three and one quarter inches and the length of the crotch insert is six and one half inches.

Figure 2:
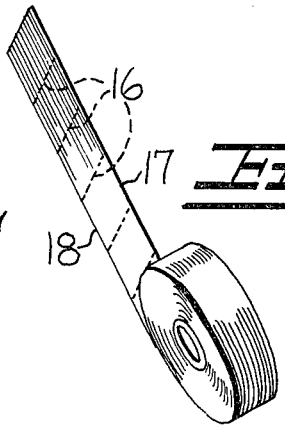
FIG. 2 is an isometric view of a roll of a relatively narrow length of warp knit fabric of the type from which the crotch inserts are formed.

Although the strip of fabric is illustrated in FIG. 2 as being formed into a roll, it is to be understood that the strip of fabric may be folded or suitably coiled into a recepticle from which it may be easily removed. The individual crotch inserts C can be readily formed at one end by diagonally cutting the strip material along the dash dot lines 16 in the manner indicated in FIG. 2. While the sewing of the crotch patch C has been described as manually carried out by the sewing operator, it is to be understood that the formation of the crotch inserts from a strip of material may also be carried out in an automatic or semi-automatic operation. The use of a continuous strip of frabric will facilitate the automatic slitting and sewing of the hosiery blanks because it is possible to feed the strip material into position so that the leading end of the angular cut strip material may be sewn in position and severed before completing the sewing of the crotch insert and the hosiery blanks.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. A lower body garment comprising (a) a pair of seamless knit legs, (b) a panty portion formed of extensions integrally knit with said legs, said extensions being longitudinally slit and seamed together, and (c) a separate single ply crotch insert of warp knit material of generally diamond-shaped configuration with pointed ends and first and second pairs of parallel side edges, said knitted crotch insert including wales extending parallel to said first pair of side edges, and courses extending perpendicular to the wales, said first pair of side edges comprising selvage edges, and said second pair of side edges comprising cut edges, and (d) seam means connecting said first and second pairs of side edges to the slit edges of said extensions so that the crotch insert is positioned on the bias in the crotch portion of the panty.

2. A lower body garment according to claim 1 wherein said warp knit crotch insert includes interconnected chains of stitch loops extending wale-wise and being knit of synthetic stretchable textured yarn, and wherein the face of said crotch insert on the inside of said panty portion includes moisture absorbent yarn inlaid in and extending between said chains of stitch loops.

3. A method of forming a lower body garment from a pair of seamless tubular blanks, the garment including a panty portion and a pair of legs, said method comprising the steps of (a) longitudinally slitting each of the seamless tubular blanks from one end and inwardly a predetermined distance, (b) forming a crotch insert for said garment by severing a predetermined length from a strip of fabric having a width substantially corresponding to the desired width of the crotch insert, said predetermined length being severed from said strip along spaced apart, substantially parallel, diagonal lines extending across said strip so that said crotch insert is diamond-shaped with two of the sides of the diamond-shape being defined by the opposite side edges of said strip and the remaining two sides being defined by the diagonal cut lines, and (c) sewing together the corresponding slit edges of the pair of tubular blanks while sewing the diamond-shaped crotch insert to the pair of tubular blanks between the slit edges and adjacent the ends of the slits.

4. A method of forming a lower body garment from a pair of seamless tubular blanks, the garment including a panty portion and a pair of legs, said method comprising the steps of (a) longitudinally slitting each of the seamless tubular blanks from one end and inwardly a predetermined distance;

(b) forming a length of fabric of a relatively narrow width, (c) diagonally cutting at spaced locations extending parallel and across the narrow length of fabric, the distance between the diagonal cuts being substantially equal to the length of the cuts to produce a diamond-shaped crotch insert, and (d) sewing together the corresponding slit edges of the tubular blanks while sewing the diamond-shaped crotch insert in position between the tubular blanks and adjacent the ends of the slits to secure the crotch insert in the crotch area of the panty portion of the garment.

5. A method according to claim 4 wherein the narrow length of fabric is formed by warp knitting synthetic stretchable yarns and forming chains of stitch loops extending parallel to opposite sides of the narrow length of fabric.

6. A method according to claim 5 including the steps of inlaying filling yarn in a coursewise direction to connect together the chains of stitch loops and form selvage edges along the opposite sides of the length of fabric.

7. A method according to claim 6 including the steps of inlaying moisture absorbent yarn in a zig-zag pattern on one face of the narrow length of fabric while connecting the moisture absorbent yarn to the chains of stitch loops, and sewing the diamond-shaped crotch insert in the crotch area with the face including the moisture absorbent yarn on the inside of the panty portion.

* * * * *